US011931617B2

(12) United States Patent
Mino et al.

(10) Patent No.: US 11,931,617 B2
(45) Date of Patent: Mar. 19, 2024

(54) TRAINING DEVICE AND BARBELL

(71) Applicant: ONE SLASH ONE Inc., Tokyo (JP)

(72) Inventors: Akihisa Mino, Tokyo (JP); Yoshihisa Fukuhara, Tokyo (JP)

(73) Assignee: ONE SLASH ONE INC., Tokyo (JP)

( * ) Notice: Subject to any disclaimer, the term of this patent is extended or adjusted under 35 U.S.C. 154(b) by 268 days.

(21) Appl. No.: 17/439,918

(22) PCT Filed: Apr. 23, 2020

(86) PCT No.: PCT/JP2020/017489
§ 371 (c)(1),
(2) Date: Sep. 16, 2021

(87) PCT Pub. No.: WO2020/218416
PCT Pub. Date: Oct. 29, 2020

(65) Prior Publication Data

US 2022/0184446 A1 Jun. 16, 2022

(30) Foreign Application Priority Data

Apr. 26, 2019 (JP) ..... 2019-086352

(51) Int. Cl.
*A63B 21/062* (2006.01)
*A63B 21/072* (2006.01)
(Continued)

(52) U.S. Cl.
CPC ..... *A63B 21/062* (2013.01); *A63B 21/0724* (2013.01); *A63B 24/0062* (2013.01);
(Continued)

(58) Field of Classification Search
CPC ..... A63B 21/062; A63B 21/0724; A63B 24/0062; A63B 24/0087; A63B 71/0054;
(Continued)

(56) References Cited

U.S. PATENT DOCUMENTS 4,527,797 A * 7/1985 Slade, Jr. ..... A63B 21/0626 482/104
4,998,723 A * 3/1991 Santoro ..... A63B 21/078 482/94

(Continued)

FOREIGN PATENT DOCUMENTS

CN 206979920 U 2/2018
JP H02-23567 U 2/1990

(Continued)

OTHER PUBLICATIONS

Jul. 28, 2020 International Search Report issued in International Patent Application No. PCT/JP2020/017489.

(Continued)

*Primary Examiner* — Andrew S Lo
*Assistant Examiner* — Andrew M Kobylarz
(74) *Attorney, Agent, or Firm* — Oliff PLC

(57) ABSTRACT

A training device for strength training is capable of performing through use of a barbell, the training device including: a frame body; a support body configured to support the barbell from below; moving means for moving the support body to ascend and descend along the frame body; control means for controlling the moving means; and state detecting means for detecting a state of the barbell or a user, wherein the control means is configured to control the moving means based on a detection signal detected by the state detecting means. With the training device, various kinds of free-weight training can be solely and safely performed.

11 Claims, 12 Drawing Sheets

(51) Int. Cl.

| | |
|---|---|
| ***A63B 24/00*** | (2006.01) |
| ***A63B 71/00*** | (2006.01) |
| ***A63B 71/06*** | (2006.01) |

(52) U.S. Cl.
CPC ..... *A63B 24/0087* (2013.01); *A63B 71/0054* (2013.01); *A63B 71/0622* (2013.01); *A63B 2071/068* (2013.01); *A63B 2220/52* (2013.01); *A63B 2225/093* (2013.01); *A63B 2225/096* (2013.01)

(58) Field of Classification Search
CPC ..... A63B 71/0622; A63B 2071/068; A63B 2220/52; A63B 2225/093; A63B 2225/096; A63B 21/00181; A63B 21/0783; A63B 2024/0093; A63B 23/1218; A63B 2071/0063; A63B 21/4045; A63B 2220/13; A63B 2220/16; A63B 2220/40; A63B 2220/56; A63B 2220/805; A63B 2220/806; A63B 2225/12; A63B 2230/062
See application file for complete search history.

(56) References Cited

U.S. PATENT DOCUMENTS

| | | | | |
|---|---|---|---|---|
| 6,086,520 | A | 7/2000 | Rodriquez | |
| 6,558,299 | B1 * | 5/2003 | Slattery | A63B 21/0783 482/4 |
| 2009/0137368 | A1 * | 5/2009 | Parrilla | A63B 21/078 482/104 |
| 2014/0256517 | A1 * | 9/2014 | Poppinga | A63B 21/078 482/104 |

FOREIGN PATENT DOCUMENTS

| | | | | |
|---|---|---|---|---|
| JP | 2003-508136 | A | 3/2003 | |
| JP | 2010-187883 | A | 9/2010 | |
| JP | 3193609 | U | 10/2014 | |
| JP | 6225374 | B1 | 11/2017 | |
| JP | 6879580 | B2 | 6/2021 | |
| KR | 10-0657716 | B1 | 12/2006 | |
| WO | 01/15780 | A2 | 3/2001 | |
| WO | 2005/030341 | A1 | 4/2005 | |
| WO | WO-2005030341 | A1 * | 4/2005 | A63B 21/00181 |

OTHER PUBLICATIONS

Jul. 28, 2020 Written Opinion issued in International Patent Application No. PCT/JP2020/017489.
Dec. 22, 2020 Office Action issued in Japanese Patent Application No. 2019-086352.

* cited by examiner

W
W1
W2
20
30
31
32
SUPPROT BODY ASCENDING
SHAFT PROXIMITY DETECTION
DECELERATION
SHAFT CONTACT DETECTION
ACCELERATION
SUPPROT BODY ASCENDING

TRAINING DEVICE AND BARBELL

TECHNICAL FIELD

The present invention relates to a training device, and more specifically, to a training device with which free-weight training can be solely and safely performed and a barbell to be used together with the training device.

BACKGROUND ART

Methods of strength training utilizing equipment (excluding so-called "bodyweight training") can be roughly divided into two types. One type is machine training using a dedicated device equipped with a weighted object, and the other type is free-weight training using, for example, a dumbbell or a barbell (hereinafter referred to as "weighted object").

In the free-weight training, a person who performs the training (hereinafter referred to as "user") is required to use his or her whole body to support a weight while keeping a balance. Thus, the free-weight training is said to have a higher training effect as compared to the machine training in which the weight passes a constant path and the balance is mechanically maintained.

The user can perform the free-weight training alone, but with assistance by a spotter, there are advantages in that more effective training is allowed (for example, pushing muscles to exhaustion and preventing injury), and more efficient training is allowed (showing effects in a shorter period of time).

In recent years, there has been proposed a training device configured so that training can be performed in an environment similar to the free-weight training with a spotter (Patent Literature 1).

CITATION LIST

Patent Literature

[PTL 1] JP 2003-508136 A1

SUMMARY OF INVENTION

Technical Problem

However, the training device described in Patent Literature 1 has a configuration in which a weighted object (barbell) is supported by wires, and thus has a problem in terms of safety.

In order to solve the problem, the present invention provides a training device with which various kinds of free-weight training can be solely and safely performed and a barbell to be used together with the training device.

Solution to Problem

According to the present invention, there is provided a training device for strength training to be performed through use of a weighted object (barbell), the training device including: a frame body; a support body configured to support the barbell from below; moving means for moving the support body to ascend and descend along the frame body; control means for controlling the moving means; and state detecting means for detecting a state of the barbell or a user, wherein the control means is configured to control the moving means based on a detection signal detected by the state detecting means, wherein the support body includes: a front-and-rear direction guiding portion configured to guide the barbell having a longitudinal direction in a right-and-left direction to a predetermined position in a front-and-rear direction of the support body; and a lateral direction guiding portion configured to guide the barbell to a predetermined position in the right-and-left direction of the support body, wherein the front-and-rear direction guiding portion includes: a first downward-inclined surface having a downward inclination from one end side in a longitudinal direction of the support body being a front-and-rear direction toward a middle portion side in the longitudinal direction of the support body; a second downward-inclined surface having a downward inclination from another end side in the longitudinal direction of the support body toward the middle portion side in the longitudinal direction of the support body; and a lowest portion provided on forward sides in downward directions of both of the first downward-inclined surface and the second downward-inclined surface, and wherein the lateral direction guiding portion includes an outer downward-inclined surface having a downward inclination on an outer side in a transverse direction of the support body being the right-and-left direction. According to the present invention, there is provided a barbell to be used together with the training device, the barbell including: a long bar; a flange rotatably provided on an outer periphery of the long bar; and a weight equipping portion rotatably provided on the outer periphery of the long bar, wherein the flange includes an abutment portion to be brought into abutment against a lateral direction guiding portion formed on a support body of the training device.

Advantageous Effects of Invention

According to the training device of the present invention and the barbell to be used together with the training device, the support body ascends and descends in accordance with the state detecting means for detecting the state of the barbell or the user, and hence various kinds of free-weight training can be solely and safely performed.

DESCRIPTION OF EMBODIMENTS

First Embodiment

An example of a training device and a barbell according to the present invention is described with reference to the drawings. The training device according to the present invention is a device for strength training to be performed through use of a weighted object. In the following, as an example, description is given of a case in which the weighted object is a barbell W in which plates (weights) W2 are provided on both ends in a longitudinal direction of a shaft W1.

Figure 1A:
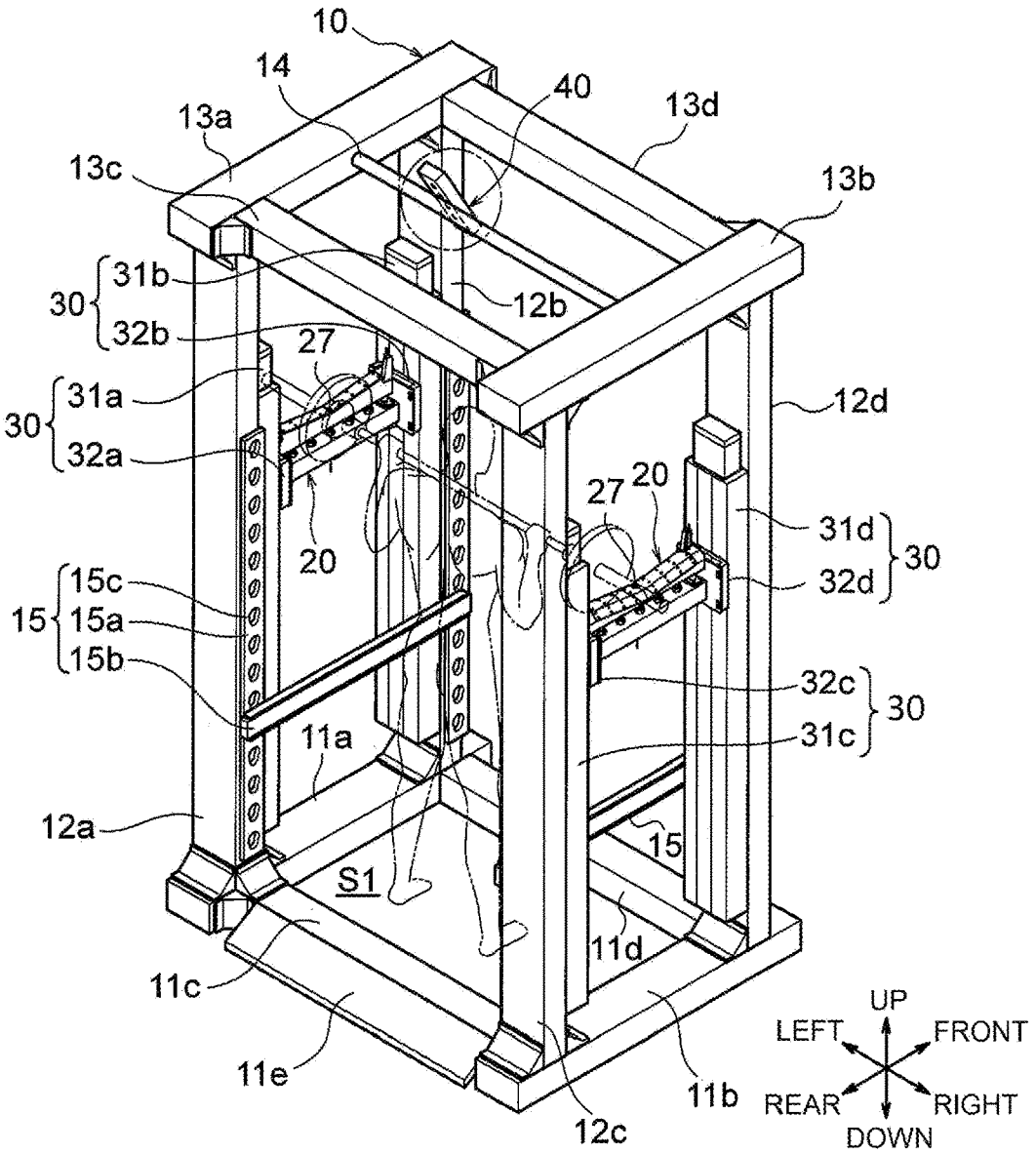
FIG. 1(*a*) is a perspective view for illustrating an example of a training device according to the present invention, and FIG. 1(*b*) is an enlarged view of a portion surrounded by a circle of FIG. 1(*a*).
Figure 1B:
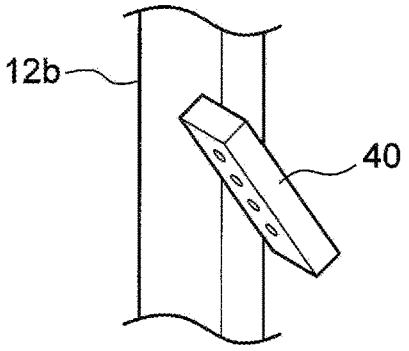

As an example, the training device illustrated in FIG. 1(*a*) includes a frame body 10, a support body 20, moving means 30, state detecting means 40, and control means 50. The support body 20 is configured to support the barbell W. The moving means 30 is configured to move the support body 20 to ascend and descend along the frame body 10. The state detecting means 40 is configured to detect a state of the barbell W or a user. The control means 50 is configured to control the moving means 30.

The frame body 10 is a part serving as a framework of the training device. The frame body 10 in this embodiment includes two frame body bases 11*a* and 11*b* and four support columns 12 (first support column 12*a* to fourth support column 12*d*). The two frame body bases 11*a* and 11*b* are arranged in parallel to each other at an interval on left and right sides, respectively. The four support columns 12 are provided upright at an interval in a front-and-rear direction of each of the frame body bases 11*a* and 11*b*. Both the frame body bases 11*a* and 11*b* have one end sides coupled to each other by a first base coupling member 11*c*, and other end sides coupled to each other by a second base coupling member 11*d*. A step plate 11*e* is provided on the first base coupling member 11*c*.

Among the four support columns 12, the first support column 12*a* and the second support column 12*b* are coupled to each other by a first coupling member 13*a*, and the third support column 12*c* and the fourth support column 12*d* are coupled to each other by a second coupling member 13*b*. Between the first coupling member 13*a* and the second coupling member 13*b*, a third coupling member 13*c* is bridged on one end side, a fourth coupling member 13*d* is bridged on another end side, and a pull-up/chin-up bar 14 is bridged at a middle position. On an inner side of the four support columns 12*a* to 12*d*, a training space S1 in which a user performs training is formed.

An auxiliary support body 15 is provided on inner surface sides of the four support columns 12*a* to 12*d*. The auxiliary support body 15 in this embodiment includes locking plates 15*a* fixed to the support columns 12, respectively, and a safety bar 15*b* removably mounted to the locking plates 15*a*.

The locking plates 15*a* in this embodiment are each a vertically-long plate-shaped member arranged along the support column 12, and each have, on its surface, a plurality of locking holes 15*c*, to which the safety bar 15*b* is lockable, and which are formed at intervals in a height direction.

The safety bar 15*b* in this embodiment is a bar-shaped member having locking protrusions (not shown) provided on its back surface. The safety bar 15*b* is arranged in parallel to the first coupling member 13*a* and the second coupling member 13*b*. The safety bar 15*b* can be mounted to the locking plates 15*a* when the locking protrusions are locked to any locking holes 15*c* suitable for the training type. The auxiliary support body 15 may be provided as required, and can be omitted when not required.

The configuration of the frame body 10 is merely an example, and other configurations can also be adopted.

The support body 20 is configured to support the barbell W from below. In this embodiment, one support body 20 is provided between the first support column 12*a* and the second support column 12*b*, and another support body 20 is provided between the third support column 12*c* and the fourth support column 12*d* (two support bodies 20 in total). The two support bodies 20 are provided at opposed positions at the same height. The barbell W is horizontally supported on both end sides in the longitudinal direction thereof by those two support bodies 20.

Figure 2A:
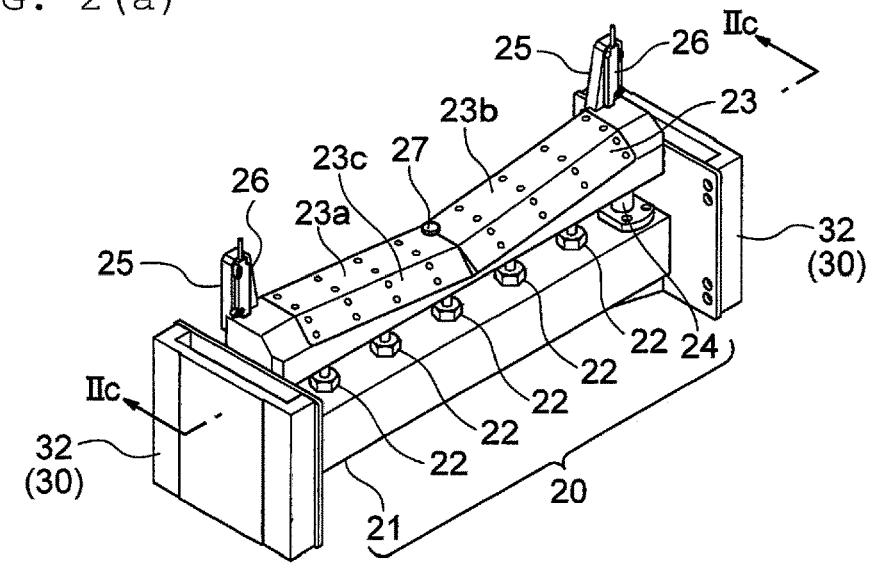
FIG. 2(*a*) is a perspective view for illustrating an example of a support body, FIG. 2(*b*) is a front view of the support body of FIG. 2(*a*), and FIG. 2(*c*) is a sectional view taken along the line IIc-IIc of FIG. 2(*a*).
Figure 2B:
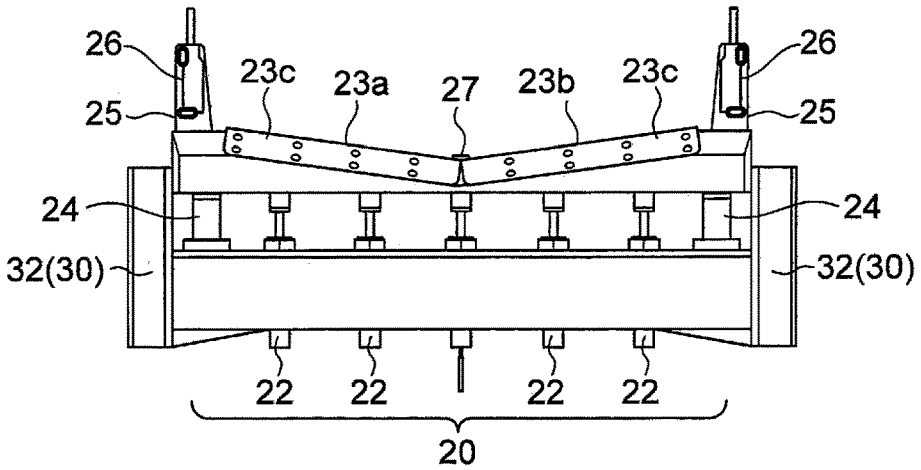
Figure 2C:
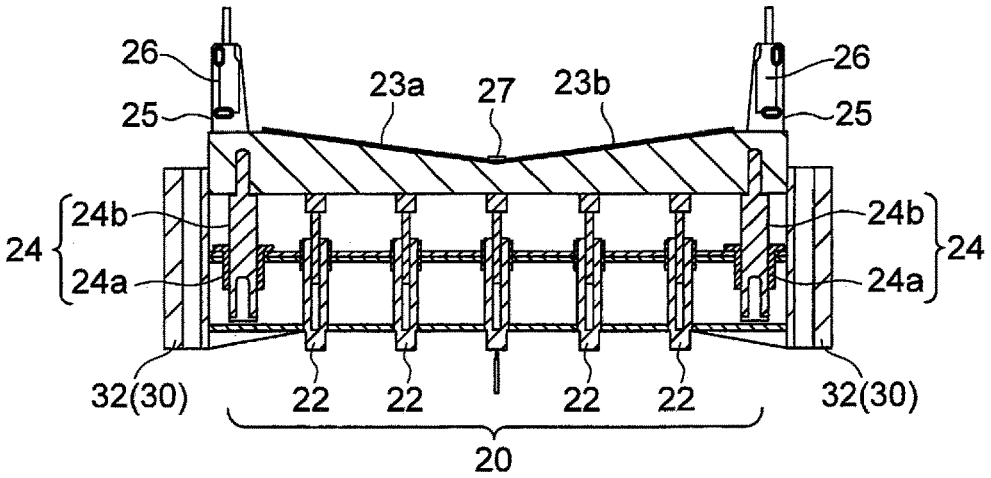

As an example, the support body 20 illustrated in FIG. 2(*a*) to FIG. 2(*c*) includes a support body base 21, dampers 22, and a receiving portion 23. The dampers 22 are provided at intervals in a width direction of the support body base 21. The receiving portion 23 is provided above the dampers 22.

The support body base 21 has a horizontally-long box shape, and both ends in the width direction thereof are held by sliders 32 to be described later. The support body base 21 has shock absorbers provided thereon as the dampers 22 configured to reduce the impact applied to the receiving portion 23. In this embodiment, as an example, there is shown a case in which five shock absorbers are provided, but the number of shock absorbers may be larger or smaller than five.

As illustrated in FIG. 2(*c*), guides 24 are provided on outer sides of, among the five shock absorbers, shock absorbers arranged on both outer sides. The guides 24 each include a bush 24*a* and a shaft 24*b* accommodated in the bush 24*a*. The guides 24 are configured to guide the receiving portion 23 so that the receiving portion 23 is vertically movable without shifting in a horizontal direction. The bushes 24*a* are provided on the support body base 21, and the shafts 24*b* are provided on the receiving portion 23.

The receiving portion 23 is provided above the five shock absorbers. The receiving portion 23 is a part configured to support the barbell W from below. The receiving portion 23 has a support surface for supporting the weighted object. The receiving portion 23 in this embodiment is formed into a V-shape having downward inclinations from both end sides in a longitudinal direction toward a middle portion. The barbell W is supported under a state in which the barbell W is movable on the support surface.

Figure 3A:
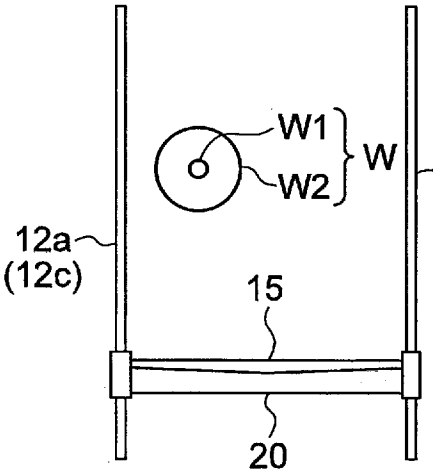
FIG. 3(*a*) to FIG. 3(*c*) are explanatory views of an operation performed when a barbell is guided to a middle portion in a front-and-rear direction of a receiving portion.
Figure 3B:
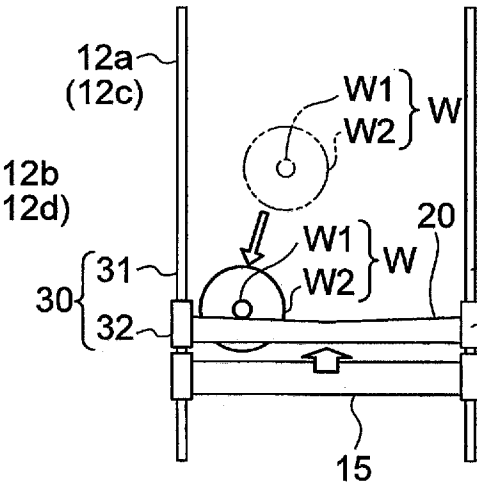
Figure 3C:
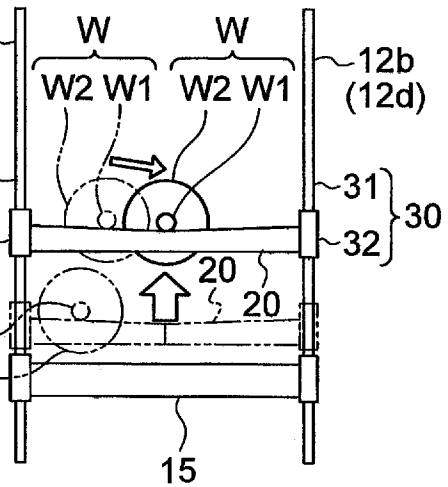

Both inclined surfaces of the receiving portion 23 (front downward-inclined surface 23*a* and rear downward-inclined surface 23*b*) function as a guiding portion (front-and-rear direction guiding portion) configured to guide the barbell W to a middle portion (lowest portion) in the front-and-rear direction (FIG. 3(*a*) to FIG. 3(*c*)). The receiving portion 23 can be formed so that the lowest portion is located at a position shifted to the front or rear side from the middle portion. The receiving portion 23 may have a horizontal upper surface.

The receiving portion 23 in this embodiment has, in addition to the front downward-inclined surface 23*a* and the rear downward-inclined surface 23*b*, an outer downward-inclined surface 23*c* inclined outward. The outer downward-inclined surface 23*c* functions as a guiding portion (lateral direction guiding portion) configured to guide the barbell W to a middle portion in a right-and-left direction.

Figure 4A:
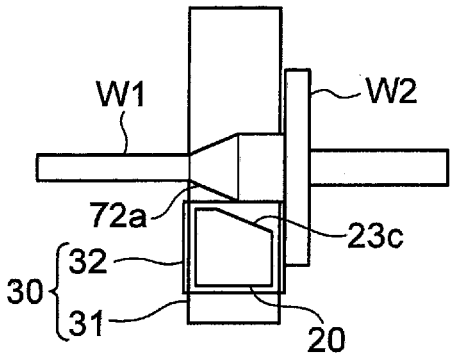
FIG. 4(*a*) to FIG. 4(*c*) are explanatory views of an operation performed when the barbell is guided to a middle portion in a right-and-left direction of the receiving portion.
Figure 4B:
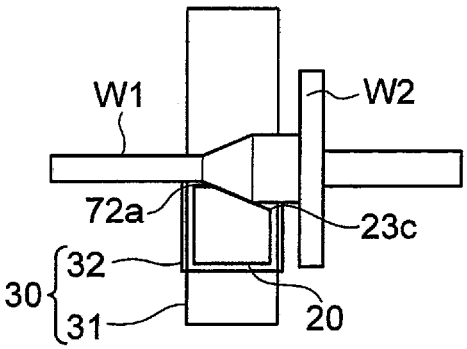
Figure 4C:
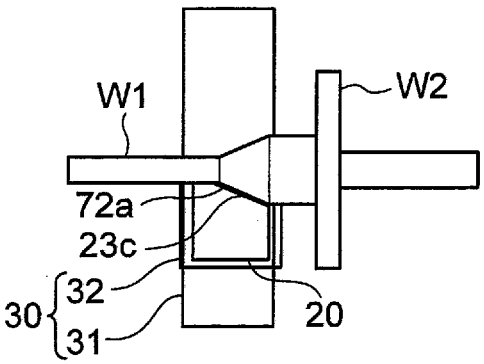

Specifically, when a barbell 70 (see FIG. 11(*a*) to FIG. 11(*c*)) to be described later is used, a conical portion 72*a* of a flange 72 is brought into abutment against the outer downward-inclined surface 23*c* so that the barbell 70 is guided to the middle portion in the right-and-left direction (FIG. 4(*a*) to FIG. 4(*c*)).

Sensor brackets 25 are provided one by one on both end sides in the longitudinal direction of the receiving portion 23, and proximity detecting means 26 is provided on each of the sensor brackets 25. The proximity detecting means 26 is means for detecting that the weighted object is brought closer to the support body beyond a reference separation distance.

As the proximity detecting means 26, for example, various laser sensors can be used, but sensors other than the laser sensors can also be used.

In this embodiment, contact detecting means 27 (FIG. 5) for detecting that the barbell W is brought into contact with the support body 20 (receiving portion 23) is provided on the receiving portion 23. In this embodiment, a load sensor is used as the contact detecting means 27.

As the contact detecting means 27, means other than the load sensor can also be used as long as the means can detect the contact to the support body 20 (receiving portion 23). For example, a physical switch configured to turn on in response to contact of the barbell W, or an eddy current sensor configured to measure a distance with respect to the barbell W through use of a high frequency magnetic field can be used. The contact detecting means 27 may be provided as required, and can be omitted when not required.

The configuration of the support body 20 is merely an example, and other configurations can also be adopted.

The moving means 30 is configured to move the support body 20 to ascend and descend along the support columns 12 of the frame body 10. In this embodiment, a linear actuator is used as the moving means 30. The linear actuator includes a guide rail 31, and the slider 32 configured to slide along the guide rail 31.

In this embodiment, one guide rail 31 is provided on a front surface side of the first support column 12*a*, one guide rail 31 is provided on a rear surface side of the second support column 12*b*, one guide rail 31 is provided on a front surface side of the third support column 12*c*, and one guide rail 31 is provided on a rear surface side of the fourth support column (four guide rails 31 in total).

A first slider 32*a* is provided on the guide rail (first guide rail 31*a*) on the front surface side of the first support column 12*a*, a second slider 32*b* is provided on the guide rail (second guide rail 31*b*) on the rear surface side of the second support column 12*b*, a third slider 32*c* is provided on the guide rail (third guide rail 31*c*) on the front surface side of the third support column 12*c*, and a fourth slider 32*d* is provided on the guide rail (fourth guide rail 31*d*) on the rear surface side of the fourth support column 12*d*.

One of the two support bodies 20 is bridged between the first slider 32*a* and the second slider 32*b*, and the other thereof is bridged between the third slider 32*c* and the fourth slider 32*d*. Both the support bodies 20 are each held at both ends in the longitudinal direction by the sliders 32.

In this embodiment, all of the first slider 32*a*, the second slider 32*b*, the third slider 32*c*, and the fourth slider 32*d* are caused to ascend and descend in synchronization with each other so that both the support bodies 20 ascend and descend at the same height while keeping horizontal postures. One linear actuator may be provided for one support body 20 (one linear actuator in total). In this case, only one end side in the longitudinal direction of each support body 20 is held by the slider 32 with an actuator, and the other end side thereof is held by the slider 32 without an actuator.

The linear actuator in this embodiment is controlled by the control means 50. The control of the linear actuator is to be described later. As long as the means can move the support body 20 to ascend and descend, means other than a linear actuator can be used as the moving means 30.

The state detecting means 40 is means for detecting a state of the barbell W or the user. In this embodiment, a depth camera (depth sensor) is used as the state detecting means 40. The depth camera in this embodiment is configured to detect position information of the shaft W1 of the barbell W. The depth camera in this embodiment can measure a distance from the depth camera to the barbell W (shaft W1).

As illustrated in FIG. 1(*a*) and FIG. 1(*b*), in this embodiment, the depth camera is provided on an upper part of the second support column 12*b* so that a lower end portion of the depth camera is positioned on the upper side by about 40 cm from an upper surface of the support body 20 at the highest position. The depth camera can be provided at other positions. An installation position and an installation angle of the depth camera can be adjusted as appropriate so that a desired angle of view can be obtained. In this embodiment, as an example, there is shown a case in which one depth camera is used, but two or more depth cameras can also be provided.

Although not shown, information acquired by the depth camera is transmitted to a processing unit connected to the depth camera, and is processed by the processing unit. In this embodiment, in the processing unit, a moving speed, a path, and a lateral balance of the barbell W can be calculated based on a change over time of the position information acquired by the depth camera.

Specifically, an angle of the barbell W can be calculated based on the number of pixels, and the position of the shaft W1 can be identified from the calculated angle and the distance to the shaft W1 measured by the depth camera.

In this embodiment, the information acquired by the depth camera and the information calculated by the processing unit are transmitted to the control means 50, and the moving means 30 is controlled based on the transmitted pieces of information.

As the state detecting means 40, other than the depth camera, an optical camera configured to shoot, for example, a motion of the barbell or a motion of the user, and a sound sensor configured to detect, for example, voice output from the user can also be used.

When the optical camera is used as the state detecting means 40, a position, a moving speed, a path, a lateral balance, or the like of the barbell W can be calculated through machine learning from image data (moving image) obtained by the optical camera. Also in this case, the information acquired by the optical camera and the information calculated by the processing unit can be transmitted to the control means 50, and the moving means 30 can be controlled based on those transmitted pieces of information.

When the sound sensor is used as the state detecting means 40, it can be determined that the user has reached the limit when the sound sensor detects voice of the user, and the moving means 30 can be controlled in response thereto.

The state detecting means 40 can be provided on the barbell W. For example, the barbell may be equipped with a gyroscope sensor, and the gyroscope sensor may measure an acceleration of the barbell W. The gyroscope sensor can be provided on the interior or the exterior of the barbell W. Other than the gyroscope sensor, a switch to be operated by the user may be provided on the barbell W so that the state of the user can be detected through an operation of the switch.

The configuration of the state detecting means 40 is merely an example, and other configurations can also be adopted.

Figure 5:
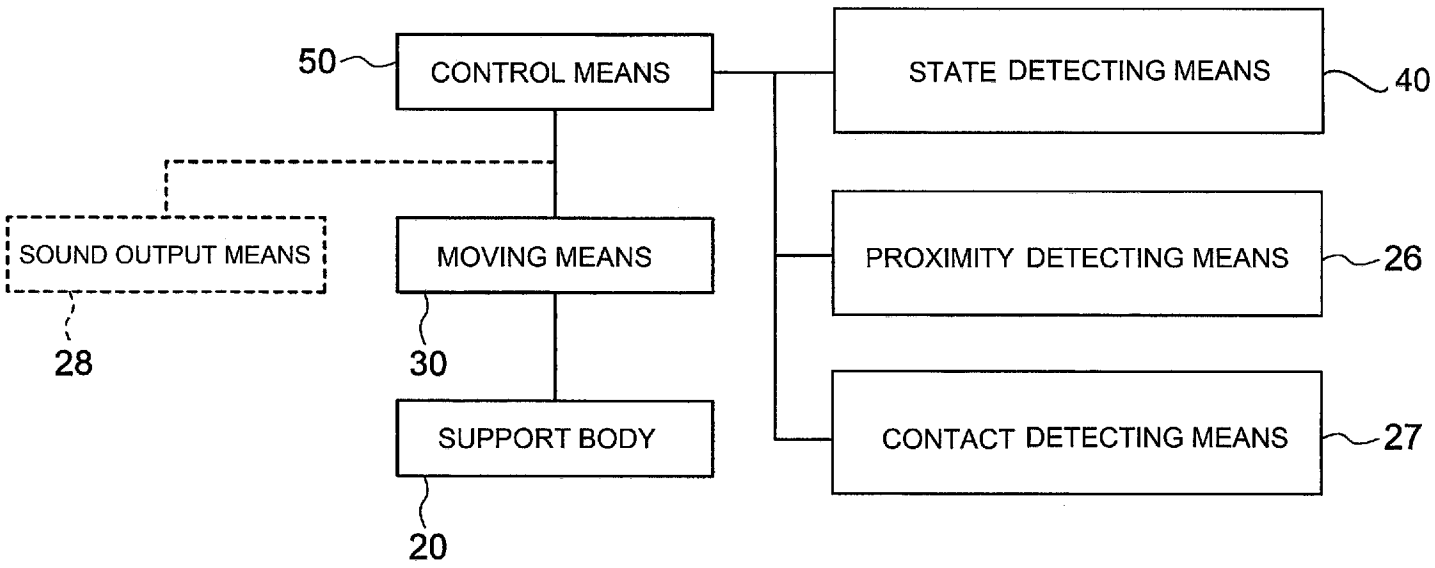
FIG. 5 is a block diagram for illustrating relationships among pieces of means.

The control means 50 is configured to control the moving means 30 and other various pieces of equipment. As illustrated in FIG. 5, in this embodiment, the moving means 30 is controlled based on a signal transmitted from the proximity detecting means 26, a signal transmitted from the contact detecting means 27, and a signal transmitted from the state detecting means 40.

Now, description is given of control that is based on the signal transmitted from the proximity detecting means 26, control that is based on the signal transmitted from the contact detecting means 27, and control that is based on the signal transmitted from the state detecting means 40. The following types of control are merely examples, and other types of control can also be performed.

Figures 6A, 6B, 6C, 6D:
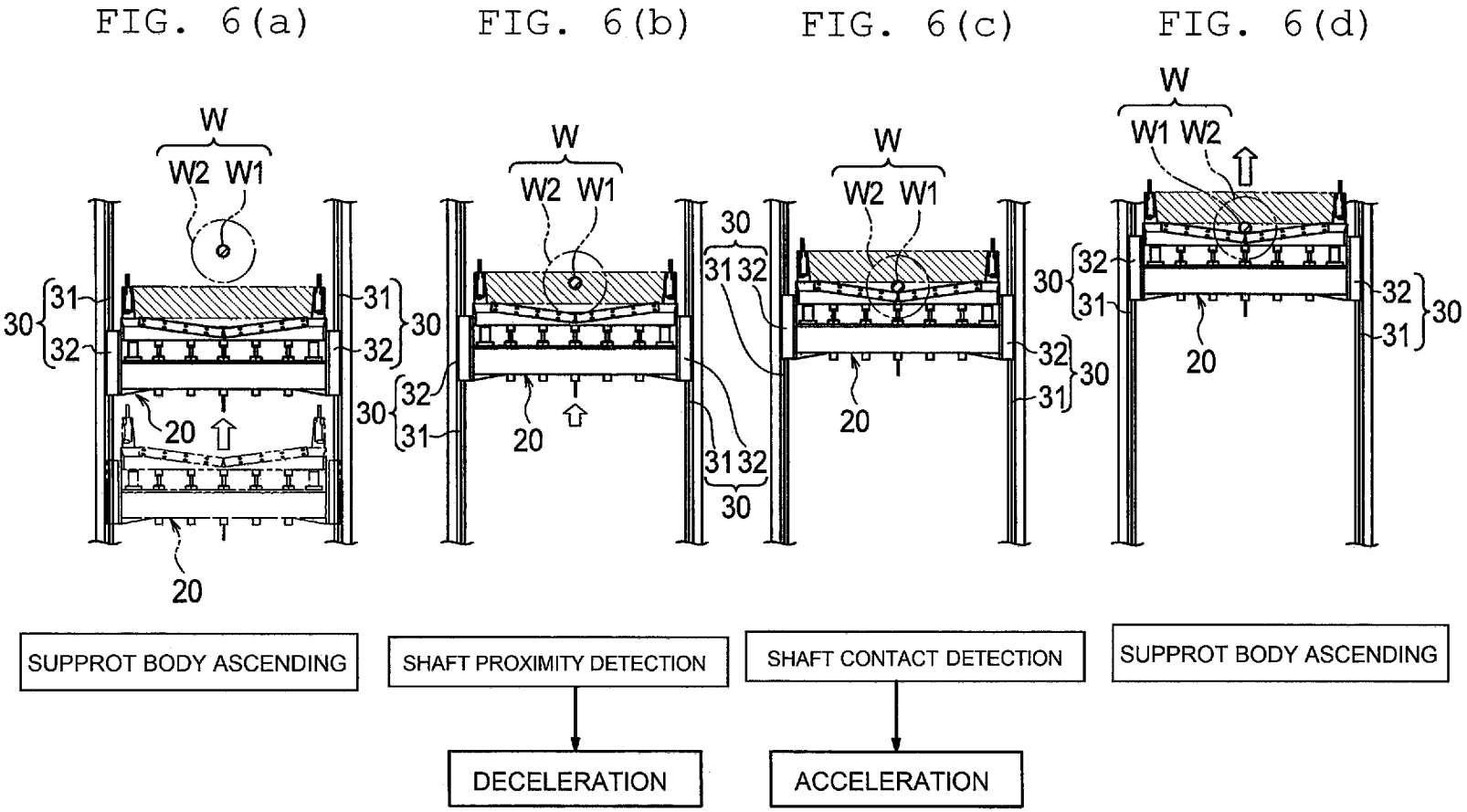
FIG. 6(*a*) to FIG. 6(*d*) are explanatory views of an operation of the support body.

First, description is given of the control that is based on the signal transmitted from the proximity detecting means 26 and the control that is based on the signal transmitted from the contact detecting means 27. As illustrated in FIG. 6(*a*) to FIG. 6(*d*), when the proximity detecting means 26 detects that the barbell W is brought closer to the support body 20 beyond the reference separation distance at the time when the support body 20 ascends, the moving means 30 is controlled so that the support body 20 is decelerated. With this control, the impact of the barbell W to be applied to the support body 20 is reduced.

After the support body 20 is decelerated by the control, when the contact detecting means 27 detects that the barbell W is brought into contact with the support body 20, the moving means 30 is controlled so that the support body 20 is accelerated. With this control, the barbell W is caused to rapidly ascend, thereby being capable of preventing the user from being crushed by the barbell W.

In a simulation performed by the applicant, when the support body 20 was brought into contact with the barbell W (stationary state) of 120 kg held by the user at a moving speed of 270 mm/s, an impact force was 893 kgf, but when the moving speed of the support body 20 was decreased to 50 mm/s, the impact force was 31 kgf. From the simulation results, a great damping effect due to the deceleration of the support body 20 was recognized.

In the control, the moving means 30 can be controlled as follows. Instead of supporting the entire (100%) load to be applied to the support body 20, a difference between a weight of the barbell W set in advance and a weight detected by the contact detecting means (load sensor) 27 may be calculated, and assistance may be given by an amount corresponding to the difference.

For example, in a case in which the weight of the barbell W set in advance is 100 kg, when the weight detected by the load sensor is 30 kg, it can be determined that the user still has strength to lift up a weight of 70 kg, and the control can be performed to give assistance by an amount corresponding to the lacking weight of 30 kg.

Next, description is given of the control that is based on the signal transmitted from the state detecting means 40. In this embodiment, the moving means 30 is controlled in accordance with each of three modes of a "normal mode (Normal MODE)," a "forced-reps mode (Forced-Reps MODE)," and a "drop-sets mode (Drop-Sets MODE)."

The "normal mode (Normal MODE)" is a mode in a case in which training similar to general free-weight training to be performed without a spotter is performed. The "forced-reps mode (Forced-Reps MODE)" is a mode in a case in which training similar to forced-reps training is performed. The "drop-sets mode (Drop-Sets MODE)" is a mode in a case in which training similar to drop-sets training is performed.

In this case, the forced-reps training refers to a training method in which the spotter supports the lifting of the barbell W when the user cannot lift up the barbell W anymore, thereby being capable of increasing the number of lift-up times of the barbell W as compared to a case in which the user performs the training alone.

Further, the drop-sets training refers to a training method in which the spotter reduces the weight of the barbell little by little at the timing at which the user comes close to the limit and cannot lift up the barbell W any more, thereby being capable of increasing the number of lift-up times of the barbell W as compared to the case in which the user performs the training alone. Both of the methods are said to be one of most efficient training methods with which results can be achieved in a short period of time.

Now, description is given of the control in each of the training modes of the "normal mode (Normal MODE)," the "forced-reps mode (Forced-Reps MODE)," and the "drop-sets mode (Drop-Sets MODE)."

Figure 7:
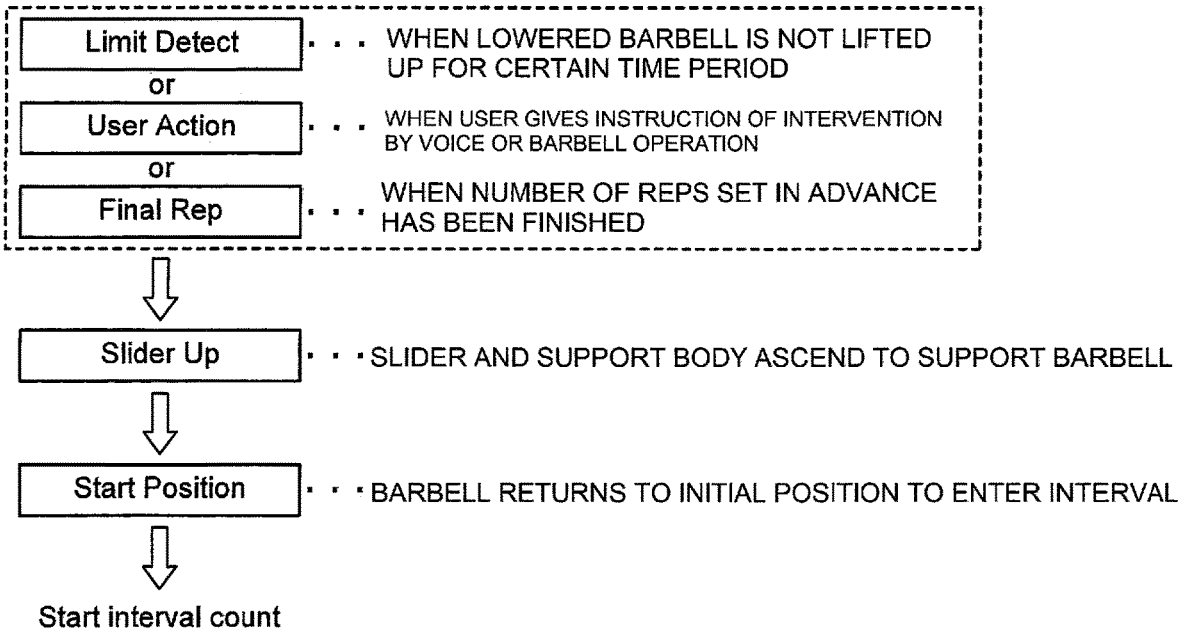
FIG. 7 is an explanatory diagram of an operation of the support body in a normal mode.

As illustrated in FIG. 7, in the "normal mode (Normal MODE)," when the state detecting means 40 detects that the barbell W lowered to the bottom is not lifted up for a certain time period or more (Limit Detect), that the user has given an instruction of intervention by voice or a barbell operation (User Action), or that the number of repetitions set in advance has been finished (Final Rep), the moving means 30 is controlled so that the support body 20 ascends (Slider Up).

The state detecting means 40 may detect, in addition to the above, intervention instructions of the user given by methods other than the voice or the barbell operation (for example, a switch to be stepped by a foot) or a body state of the user (for example, an abnormality in heart rate), and the moving means 30 may be controlled based on the detection results.

Further, when the state detecting means 40 detects a state in which there is a high probability of injury or accident, the moving means 30 may be controlled so that the support body 20 ascends. Specifically, the state detecting means 40, for example, the optical camera can measure a training form in real time, and when a state in which a form collapse leading to injury or an actual unbalance causing falling becomes apparent (for example, when the form of the user falls outside of a range of a reference form set in advance), the control can be performed so that the support body 20 automatically ascends to hold the barbell W. Similarly, when the state detecting means 40, for example, a vital sensor detects that vitals such as heartbeat and breathing have abnormal values (for example, the vital data of the user falls outside of a range of reference vitals set in advance), the control can be performed so that the support body 20 automatically ascends to hold the barbell W.

After that, when the barbell W ascends to reach a start position by the support body 20, the moving means 30 is controlled so that the support body 20 is stopped at this position (Start Position).

When the support body 20 ascends, sound output means 28 (FIG. 5) can output an alert.

Figure 8:
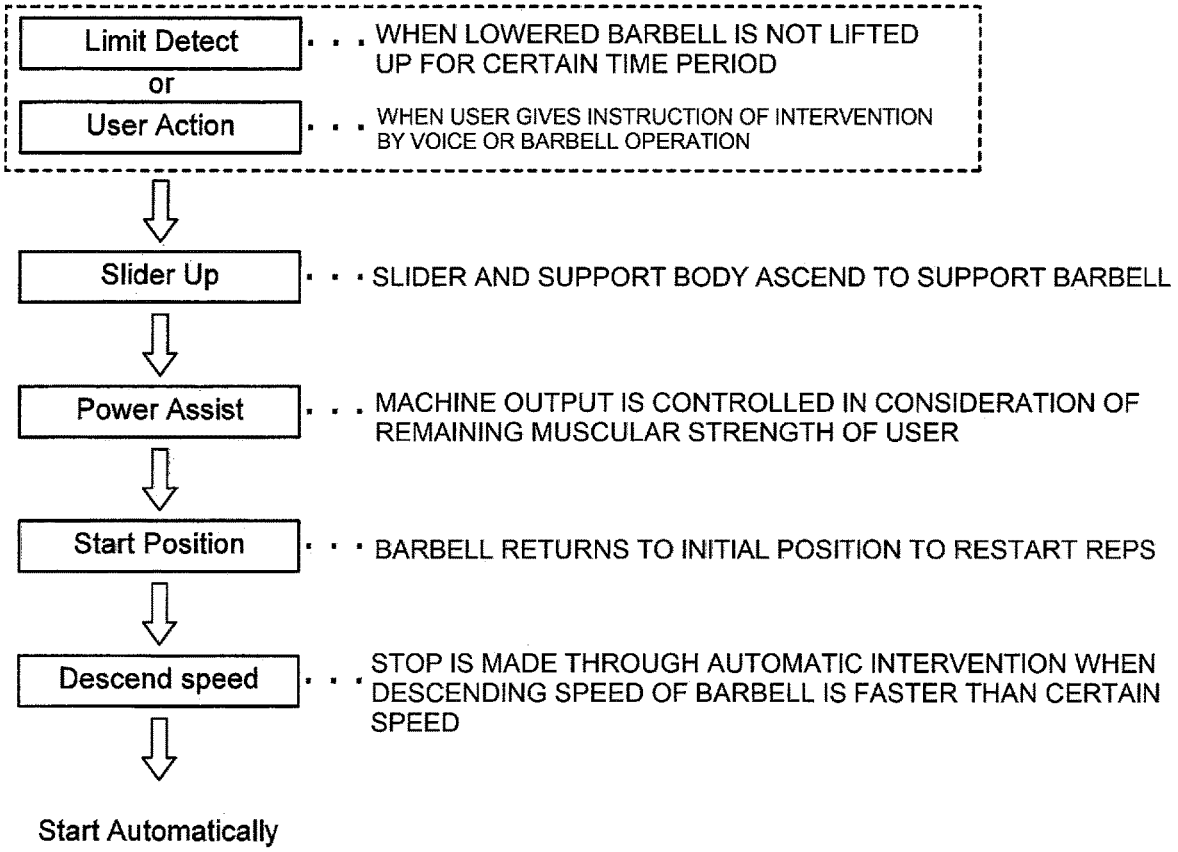
FIG. 8 is an explanatory diagram of an operation of the support body in a forced-reps mode.

As illustrated in FIG. 8, in the "forced-reps mode (Forced-Reps MODE)," when the state detecting means 40 detects that the barbell W lowered to the bottom is not lifted up for a certain time period or more, or that the user has given an instruction of intervention by voice or a barbell operation, the moving means 30 is controlled so that the support body 20 ascends to reach a position at which the support body 20 can support the barbell W.

When the barbell W is supported by the ascending support body 20, the moving means 30 is controlled so that the support body 20 ascends in consideration of the remaining muscular strength of the user (Power Assist).

After that, when the barbell W ascends to reach the start position by the support body 20, the support by the support body 20 is canceled.

In this mode, the control is performed until the number of repetitions set in advance is finished. Meanwhile, when the state detecting means 40 detects that a descending speed of the barbell W is faster than a speed set in advance (Descend Speed), the moving means 30 is controlled so that the support body 20 ascends to reach a position at which the support body 20 can support the barbell W. When the barbell W is supported by the support body 20, the moving means 30 is automatically stopped.

Similarly to the case of the "normal mode (Normal MODE)," also in this mode, when the support body 20 ascends, the sound output means 28 (FIG. 5) can output an alert.

Figure 9:
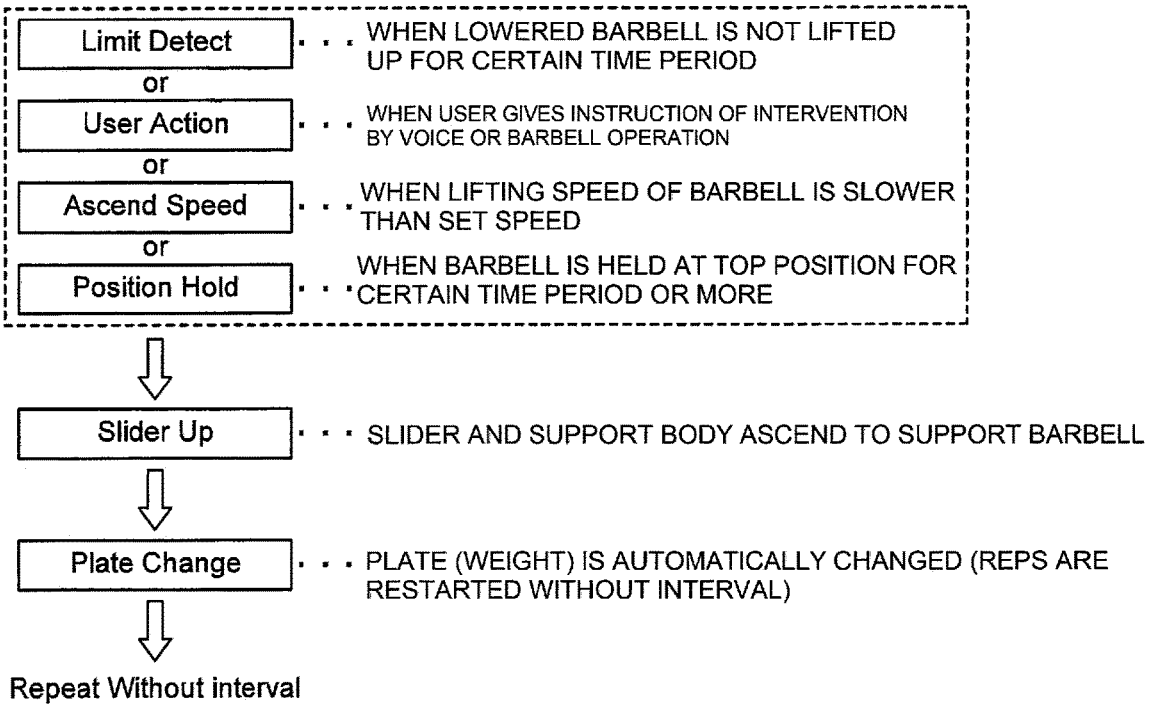
FIG. 9 is an explanatory diagram of an operation of the support body in a drop-sets mode.

As illustrated in FIG. 9, in the "drop-sets mode (Drop-Sets MODE)," when the state detecting means 40 detects that the barbell W lowered to the bottom is not lifted up for a certain time period or more, that the user has given an instruction of intervention by voice or a barbell operation, that a speed to lift up the barbell is slower than a speed set in advance (Ascend Speed), or that the barbell is held at a top position (position obtained when the user extends his or her arms) for a certain time period set in advance or more (Position Hold), the moving means 30 is controlled so that the support body 20 ascends to reach a position at which the support body 20 can support the barbell W.

When the barbell W is supported by the ascending support body 20, a weight of the weight W2 is automatically changed at a predetermined position (for example, a position of a predetermined support bar 63 of a plate rack 60 to be described later) (Plate Change). After that, the user restarts raising and lowering the barbell W without an interval.

Figures 10A, 10B, 10C:
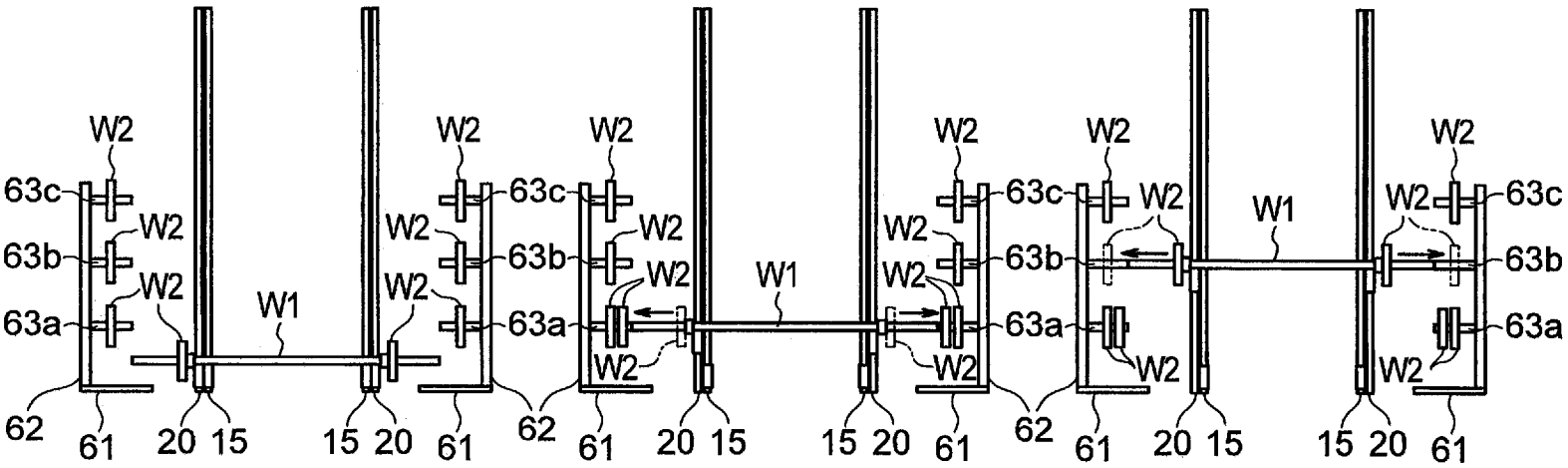
FIG. 10(*a*) to FIG. 10(*c*) are explanatory views of an operation using plate racks.

As described above, the weight W2 can be automatically changed, and hence the user is not required to replace the weight W2 by himself or herself. Thus, the user can immediately start the next set without an interval (rest), thereby being capable of efficiently performing the drop-sets training. The function of automatically changing the weight W2 is not always required, and can be omitted when not required. When the function of automatically changing the weight W2 is not used, for example, the plate rack 60 illustrated in FIG. 10(*a*) to FIG. 10(*c*) can be used.

Next, description is given of the replacement of the weight W2. The plate racks 60 illustrated in FIG. 10(*a*) to FIG. 10(*c*) are used while being arranged on both outer sides in a width direction of the frame body 10. Each of the plate racks 60 includes a scaffold plate 61, a rack support column 62 provided upright from the scaffold plate 61, and support bars 63 provided to laterally protrude from the rack support column 62.

In this embodiment, three support bars 63 are provided to protrude at intervals in a height direction of the rack support column 62. The support bars 63 of the right and left plate racks 60 are provided so that lower support bars, middle support bars, and upper support bars thereof have the same heights.

Each support bar 63 holds the weight W2. In this embodiment, the weight W2 held by the middle support bar 63*b* is lighter than the weight W2 held by the lower support bar 63*a*, and the weight W2 held by the upper support bar 63*c* is lighter than the weight W2 held by the middle support bar 63*b*.

When the user replaces the weight W2, the weight W2 mounted on the shaft W1 is slid and moved to the support bar 63 present at the same height as the shaft W1 (weight W2 in use is removed).

After that, the support body 20 is moved so that the shaft W1 is brought to the same height as a different support bar 63, and the weight W2 held by the support bar 63 is slid and moved to the shaft W1 (different weight W2 is mounted), thereby being capable of easily replacing the weight W2.

When the training device according to the present invention is used, an existing barbell W can be used, but a dedicated barbell 70 developed for the training device according to the present invention can also be used.

Figure 11A:
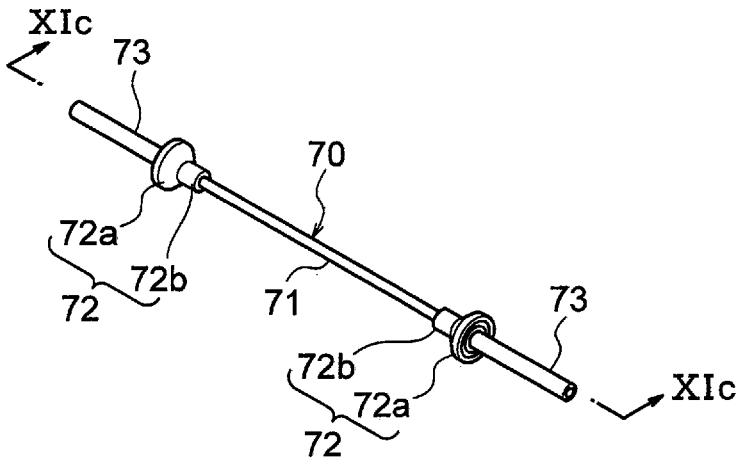
FIG. 11(*a*) is a perspective view for illustrating an example of a barbell according to the present invention, FIG. 11(*b*) is a front view of FIG. 11(*a*), and FIG. 11(*c*) is a sectional view taken along the line XIc-XIc of FIG. 11(*a*).
Figure 11B:
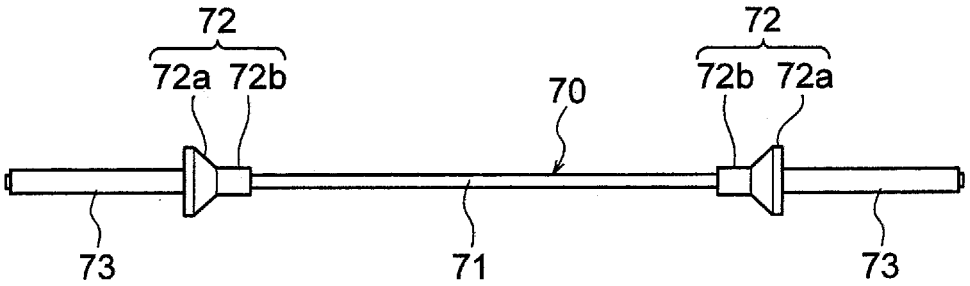
Figure 11C:
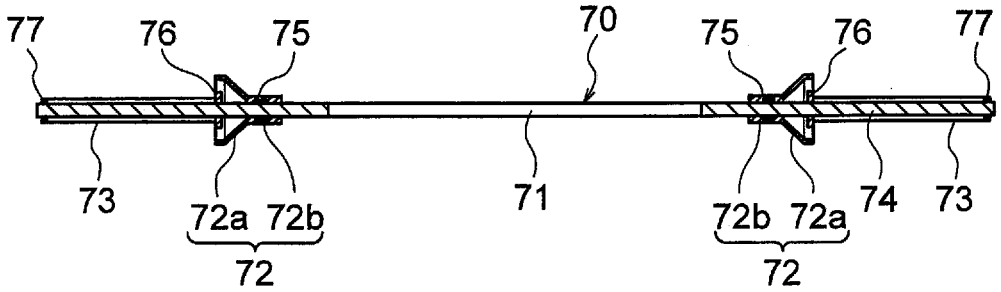

As an example, the barbell 70 illustrated in FIG. 11(*a*) to FIG. 11(*c*) is developed for the training device according to the present invention, and includes a shaft 71, flanges 72, and weight equipping portions 73. The shaft 71 is to be gripped by the user. The flanges 72 are provided at positions closer to the outer sides in the longitudinal direction of the shaft 71. The weight equipping portions 73 are provided on the outer sides of both the flanges 72. The weight W2 is to be mounted to each of the weight equipping portions 73.

As illustrated in FIG. 11(*c*), the shaft 71 has a pipe shape, and round bar-shaped core members 74 are inserted to both end portions in the longitudinal direction of the shaft 71 (the shaft 71 and/or the core members 74 is referred to as "a long bar" in this application). The flanges 72 are rotatably mounted through intermediation of first bearings 75 at positions closer to the shaft 71 of both the core members 74. As the shaft 71, a core member (member that is not hollow) may be used in place of a pipe.

Both the flanges 72 each have a shape including a cylindrical portion 72*b* on a distal end side of the conical portion 72*a*. In parts of both the core members 74 on the outer sides of both the flanges 72, the cylindrical weight equipping portions 73 are rotatably provided through intermediation of second bearings 76. Both the weight equipping portions 73 are held by lock nuts 77 so that the weight equipping portions 73 are prevented from falling off from the core members 74.

In the barbell W, the shaft 71, the flanges 72, and the weight equipping portions 73 are each rotatably coupled through intermediation of bearings. Accordingly, when the conical portion of the weight equipping portion 73 is placed on the receiving portion 23 of the support body 20, the barbell W is smoothly guided to the middle portion (lowest portion) even when the barbell W is equipped with a weight.

Further, as described above, the conical portion 72*a* of the flange 72 in the barbell W abuts against the outer downward-inclined surface 23*c* of the receiving portion 23 in the support body 20. In this manner, the barbell W is guided to the middle portion in the right-and-left direction.

The barbell 70 illustrated in FIG. 11(*a*) to FIG. 11(*c*) is merely an example, and, as the barbell W, an existing barbell and barbells having structures other than that of the barbell 70 illustrated in FIG. 11(*a*) to FIG. 11(*c*) can also be used.

Second Embodiment

Figure 12:
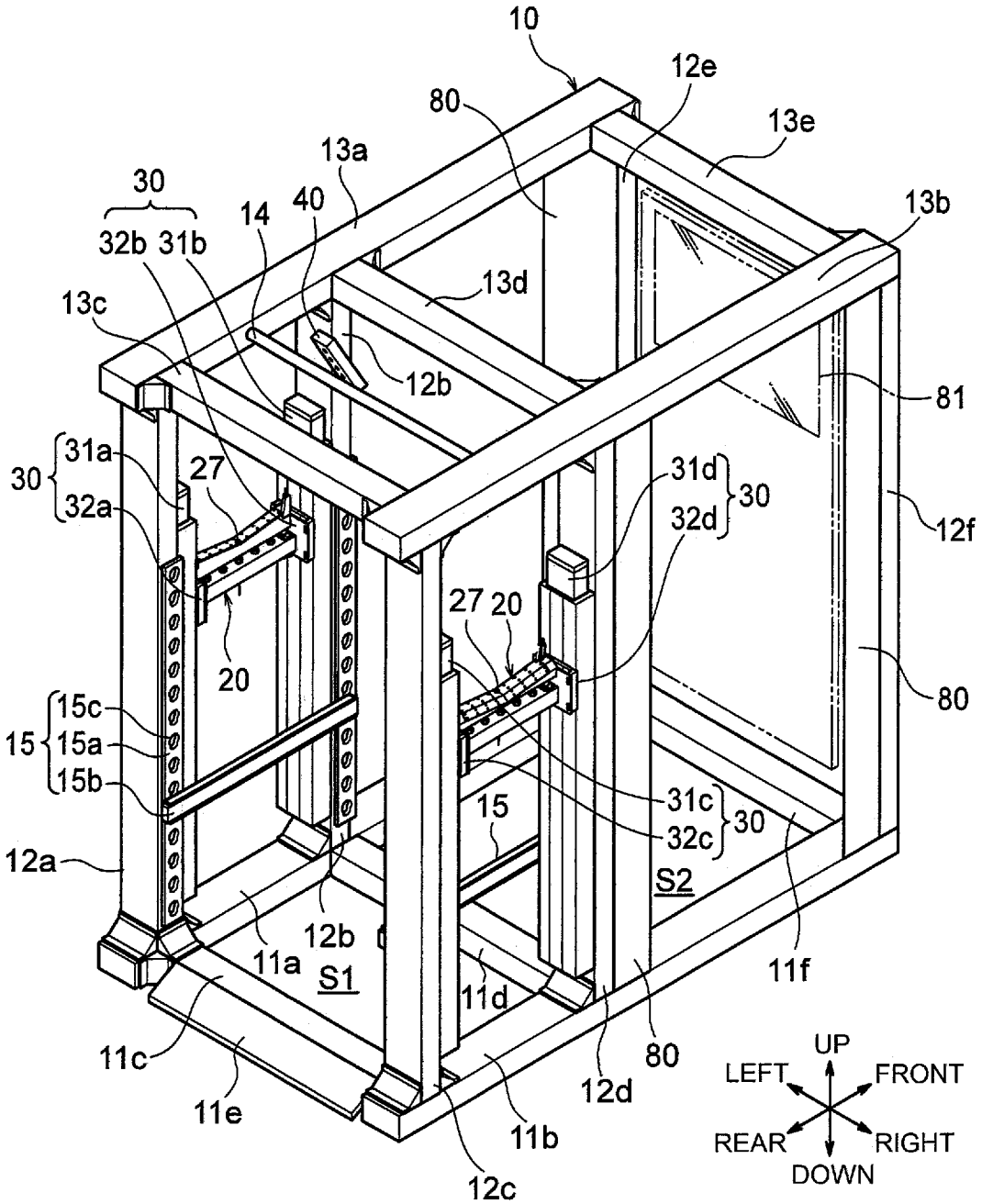
FIG. 12 is a perspective view for illustrating another example of the training device according to the present invention.

Another example of the training device according to the present invention is described with reference to the drawings. The basic configuration of the training device according to this embodiment is similar to that in the case of the first embodiment. Differences reside in that, as illustrated in FIG. 12, a physical measurement space S2 is provided on the front side of a training space S1, and that physical data acquiring means 80 for acquiring physical data of the user is provided in the physical measurement space S2. In the following, matters different from those in the first embodiment are mainly described, and description of matters similar to those in the first embodiment is omitted as appropriate.

The frame body 10 in this embodiment includes an additional first support column 12*e* provided upright on the front side of the second support column 12*b*, and an additional second support column 12*f* provided upright on the front side of the fourth support column 12*d*. The additional first support column 12*e* is provided upright on the frame body base 11*a* extended to the front side of the second support column 12*b*, and the additional second support column 12*f* is provided upright on the frame body base 11*b* extended to the front side of the fourth support column 12*d*.

Extended front end portions of both the frame body bases 11*a* and 11*b* are coupled to each other by an additional coupling member 11*f*. Upper end portions of the additional first support column 12*e* and the additional second support column 12*f* are coupled to each other by a fifth coupling member 13*e*.

As illustrated in FIG. 12, in this embodiment, the physical measurement space S2 is formed on the inner side of the second support column 12*b*, the fourth support column 12*d*, the additional first support column 12*e*, and the additional second support column 12*f*, and the physical data acquiring means 80 is provided in the physical measurement space S2. As the physical data acquiring means 80, for example, an existing 3D scanner can be used.

In this embodiment, with the physical data acquiring means 80, various kinds of physical data can be measured, such as, in addition to the height and the length of arms and legs of the user, sizes around the neck, around the upper arm, around the chest, around the waist, around the hips, around the thigh, and around the calf.

Before the training is started, the physical data acquiring means 80 can measure the physical data, and various settings of the support body 20 (for example, a top position (initial position) and a bottom position (maximum position to lower the barbell)) can be automatically adjusted based on the measured data. At this time, it is preferred that the locking plate 15*a* of the auxiliary support body 15 be fixed in the vicinity of the bottom position, and thus, for example, a display monitor 81 to be described later can be used to notify the user of the bottom position. Further, the physical data acquiring means 80 can measure the physical data before and after the training so that the contents of the training can be determined based on the data.

In this embodiment, the display monitor 81 is provided between the additional first support column 12*e* and the additional second support column 12*f*. As the display monitor 81, a mirror display having both functions of a mirror and a display, a digital signage, or the like can be used.

On the display monitor 81, various kinds of information can be displayed, such as a status of the user, training information, information related to injury, a more effective training method, and advertisements of training equipment and protein drinks.

The display monitor 81 may be provided as required, and can be omitted when not required. Further, a mirror without a display function can be provided between the additional first support column 12*e* and the additional second support column 12*f* in place of the display monitor 81.

Other Embodiment

Although description is omitted in the first and second embodiments, a lifting platform can be provided on a floor surface of the training space S1. As the lifting platform, an existing or new lifting platform, for example, a pantograph lifting platform can be used.

With the lifting platform being provided, training at a low position, for example, hip thrusts and squats, can be supported. The lifting platform may be provided as required, and can be omitted when not required.

Although description is omitted in the first and second embodiments, a measurement mat including a pressure sensor (pressure distribution sensor) can also be provided on the floor surface of the training space S1. With such a measurement mat being provided, the balance of loads applied to the feet at the time of training can be checked.

Although description is omitted in the first and second embodiments, placement stages (not shown) can be provided to both the support bodies 20 so that the user gripping the pull-up/chin-up bar 14 can place his or her legs thereon when performing the pull-up/chin-up training. The placement stages can be removed when the pull-up/chin-up training is not performed.

Through use of the placement stages, pull-up/chin-up training using the bodyweight called "chinning" can be effectively performed. It is difficult for a user having insufficient muscular strength to solely perform chinning in which the whole body weight is supported by grip and arm strength, and in general personal training, the chinning is performed under a state in which the spotter supports his or her legs, thereby being capable of increasing the training effect. However, in this embodiment, the placement stages can be used so that training similar thereto can be solely performed.

Specifically, the user can hang down from the pull-up/chin-up bar 14 and have his or her legs (knees) placed on the placement stages. The pull-up/chin-up can be performed under this state so that an effect similar to that in the case in which the chinning is performed with his or her legs being supported by the spotter can be obtained.

In the second embodiment, as an example, there is shown a case in which the training space S1 and the physical measurement space S2 are provided in one frame body 10, but the training space S1 and the physical measurement space S2 can be provided in different frame bodies 10. In this case, it is preferred that the physical measurement space S2 be provided in the vicinity of the frame body 10 forming the training space S1.

INDUSTRIAL APPLICABILITY

The training device and the barbell according to the present invention can be used at the gym, home, or the like as a highly-safe training device for free-weight training and a barbell to be used together with the training device.

REFERENCE SIGNS LIST

10 frame body
11*a*, 11*b* frame body base
11*c* first base coupling member
11*d* second base coupling member
11*e* step plate

11*f* additional coupling member
12 support column
12*a* first support column
12*b* second support column
12*c* third support column
12*d* fourth support column
12*e* additional first support column
12*f* additional second support column
13*a* first coupling member
13*b* second coupling member
13*c* third coupling member
13*d* fourth coupling member
13*e* fifth coupling member
14 pull-up/chin-up bar
15 auxiliary support body
15*a* locking plate
15*b* safety bar
15*c* locking hole
20 support body
21 support body base
22 damper
23 receiving portion
23*a* front downward-inclined surface
23*b* rear downward-inclined surface
23*c* outer downward-inclined surface
24 guide
24*a* bush
24*b* shaft
25 sensor bracket
26 proximity detecting means
27 contact detecting means
28 sound output means
30 moving means
31 guide rail
31*a* first guide rail
31*b* second guide rail
31*c* third guide rail
31*d* fourth guide rail
32 slider
32*a* first slider
32*b* second slider
32*c* third slider
32*d* fourth slider
40 state detecting means
50 control means
60 plate rack
61 scaffold plate
62 rack support column
63 support bar
63*a* lower support bar
63*b* middle support bar
63*c* upper support bar
70 barbell
71 shaft
72 flange
72*a* conical portion
72*b* cylindrical portion
73 weight equipping portion
74 core member
75 first bearing
76 second bearing
77 lock nut
80 physical data acquiring means
81 display monitor
S1 training space
S2 physical measurement space
W barbell
W1 shaft
W2 plate (weight)

The invention claimed is:

1. A training device for strength training to be performed through use of a barbell, the training device comprising:

a frame body;

a support body configured to support the barbell from below;

a linear actuator configured to move the support body to ascend and descend along the frame body;

a controller configured to control the linear actuator; and a state detecting device which includes at least one of a depth camera, an optical camera, and a vital sensor, and which is configured to detect a state of the barbell or a user, wherein the controller is configured to control the linear actuator based on a detection signal detected by the state detecting device, wherein the support body includes:

a front-and-rear direction guiding portion configured to guide the barbell having a longitudinal direction in a right-and-left direction to a predetermined position in a front-and-rear direction of the support body; and a lateral direction guiding portion configured to guide the barbell to a predetermined position in the right-and left direction of the support body, wherein the front-and-rear direction guiding portion includes:

a first downward-inclined surface having a downward inclination from one end side in a longitudinal direction of the support body being a front-and-rear direction toward a lowest portion in the longitudinal direction of the support body;

a second downward-inclined surface having a downward inclination from another end side in the longitudinal direction of the support body toward the lowest portion in the longitudinal direction of the support body; and the lowest portion provided on forward sides in downward directions of both of the first downward-inclined surface and the second downward-inclined surface, and wherein the lateral direction guiding portion includes an outer downward-inclined surface having a downward inclination on an outer side in a transverse direction of the support body being the right-and-left direction.

2. The training device according to claim 1, wherein the training device is for strength training to be performed through use of a barbell including a flange portion, and wherein the flange portion of the barbell is to be brought into abutment against the outer downward-inclined surface of the lateral direction guiding portion so that the barbell is guided to the predetermined position in the right-and-left direction of the support body.

3. The training device according to claim 1, wherein the support body includes a support body base, a damper provided on the support body base, and a receiving portion provided above the damper, and wherein the front-and-rear direction guiding portion is provided in the receiving portion.

4. The training device according to claim 1, wherein the frame body includes at least four support columns arranged at intervals, wherein at least one support body is arranged between two of the four support columns, and at least one support body is arranged between the other two of the four support columns, and wherein both sides or any one side in a longitudinal direction of each support body is held by the linear actuator.

5. The training device according to claim 4, wherein one linear actuator is provided for each support body, and wherein the one end side in the longitudinal direction of the each support body is held by a slider with the linear actuator, and the another end side in the longitudinal direction of the each support body is held by a slider without an actuator.

6. The training device according to claim 1, wherein the frame body has a training region in which the user performs training, and wherein the training device further comprises, in the training region, a lifting platform configured to ascend and descend in a height direction of the frame body, and/or a measurement mat configured to measure loads applied on feet of the user.

7. The training device according to claim 1, further comprising a 3D scanner configured to acquire physical data of the user, the 3D scanner being provided on the frame body or in vicinity of the frame body.

8. The training device according to claim 1, wherein the controller is configured to control the linear actuator so that the support body ascends when the state detecting device detects that the barbell is raised and lowered a predetermined number of times, that the barbell does not ascend for a predetermined time period or more, that a descending speed of the barbell is a reference descending speed or more, that an ascending speed of the barbell is a reference ascending speed or less, that a form of the user falls outside of a range of a reference form set in advance, that vital data of the user falls outside of a range of reference vitals set in advance, or that an intervention instruction is given from the user by voice or an operation on the barbell.

9. The training device according to claim 1, further comprising one or more laser sensors configured to detect that the barbell is brought closer to the support body beyond a reference separation distance, wherein the controller is configured to control, when the one or more laser sensors detect that the barbell is brought closer to the support body beyond the reference separation distance at the time when the support body ascends, the linear actuator so that the support body is decelerated.

10. The training device according to claim 9, further comprising a contact detecting device that includes at least one of a load sensor, a physical switch, and an eddy current sensor, and is configured to detect that the barbell is brought into contact with the support body, wherein the controller is configured to control, when the one or more laser sensors detect that the barbell is brought closer to the support body beyond the reference separation distance at the time when the support body ascends and the support body is decelerated, and then the contact detecting device detects that the barbell is brought into contact with the support body, the liner actuator so that the support body is accelerated.

11. A barbell to be used together with the training device of claim 1, the barbell comprising:

a long bar;

a flange rotatably provided on an outer periphery of the long bar; and a weight equipping portion rotatably provided on the outer periphery of the long bar, wherein the flange includes an abutment portion to be brought into abutment against a lateral direction guiding portion formed on a support body of the training device.

* * * * *